US006679009B2

(12) United States Patent
Hotes

(10) Patent No.: US 6,679,009 B2
(45) Date of Patent: Jan. 20, 2004

(54) COMPACT, ALL-WEATHER TEMPORARY SHELTER

(76) Inventor: Douglas T. Hotes, 401 Parkplace Center, #209, Kirkland, WA (US) 98033

( * ) Notice: Subject to any disclaimer, the term of this patent is extended or adjusted under 35 U.S.C. 154(b) by 81 days.

(21) Appl. No.: 10/075,214

(22) Filed: Feb. 12, 2002

(65) Prior Publication Data

US 2002/0108646 A1 Aug. 15, 2002

Related U.S. Application Data

(60) Provisional application No. 60/268,579, filed on Feb. 13, 2001.

(51) Int. Cl.[7] ..... E04B 1/32

(52) U.S. Cl. ..... 52/86; 52/79.5; 206/321; 135/92; 135/93; 135/117; 135/124; 135/136

(58) Field of Search ..... 52/86, 79.5, 63; 135/124, 128, 136, 137, 138, 92, 93, 117

(56) References Cited

U.S. PATENT DOCUMENTS

| | | | | | |
|---|---|---|---|---|---|
| 659,981 | A | | 10/1900 | McCall | |
| 2,328,197 | A | * | 8/1943 | Cowin | |
| 2,797,696 | A | | 7/1957 | Fritsche | 135/1 |
| 2,806,477 | A | | 9/1957 | Fritsche | 135/4 |
| 3,256,896 | A | | 6/1966 | Cummins | 135/4 |
| 3,480,023 | A | | 11/1969 | McConnell et al. | 135/1 |
| 3,902,288 | A | * | 9/1975 | Knudson | 52/86 |
| 3,930,344 | A | | 1/1976 | Gahler | 52/2 |
| 3,970,096 | A | * | 7/1976 | Nicolai | |
| 4,055,030 | A | * | 10/1977 | Earnshaw | 52/86 |
| 4,222,401 | A | | 9/1980 | Allweil | 135/1 |
| 4,244,384 | A | | 1/1981 | Bean | 135/4 |
| 4,649,947 | A | | 3/1987 | Tury et al. | 135/97 |
| 4,723,386 | A | * | 2/1988 | Sandow | 52/86 X |
| 4,802,500 | A | | 2/1989 | Davis | 135/97 |
| 4,831,793 | A | * | 5/1989 | Galloway et al. | 52/86 |
| 5,245,802 | A | | 9/1993 | Davis | 52/86 |
| 5,333,421 | A | * | 8/1994 | McKenna | 52/86 |
| 5,595,203 | A | * | 1/1997 | Espinosa | 135/124 |
| 5,598,668 | A | * | 2/1997 | Isom | 52/86 |
| 5,730,281 | A | * | 3/1998 | Powell et al. | 206/223 |
| 6,141,902 | A | * | 11/2000 | Boice | 47/17 |

* cited by examiner

*Primary Examiner*—Robert Canfield
(74) *Attorney, Agent, or Firm*—Dean A. Craine

(57) ABSTRACT

A large temporary shelter designed to act as a communication, maintenance, and warehouse facility in all types of climate and terrain. The shelter is engineered for durability, portability, repetitive assembly and disassembly. The shelter includes a plurality of lightweight structural arched frame supports that are easy to assemble and connect to a lightweight, rectangular-shaped base frame temporarily attached to the ground. The shelter also includes a durable outer cover and an inner liner that extends over the outside and inside surfaces of the arched frame supports. The outer cover and inner linings are spaced apart to create duct spaces between the arched frame supports for heating air conditioning. A central attic space is created between the outer cover and the inner linings which creates a large central air space for greater insulation. Formed on one end of the shelter are at least one personnel door and two double-hinged vehicle doors. In the preferred embodiment, the entire shelter is designed to fit into a compact container designed to be carried in military aircraft.

20 Claims, 10 Drawing Sheets

COMPACT, ALL-WEATHER TEMPORARY SHELTER

This is a utility patent application based on the provisional patent application (Serial No. 60/268,579) filed on Feb. 13, 2001.

BACKGROUND OF THE INVENTION

1. Field of the Invention

This invention pertains to the field of temporary shelters and, more particularly, to all-weather temporary shelters that can be stored in a compact configuration in a single container and then easily and quickly assembled.

2. Description of the Related Art

Portable shelters are commonly used by the U.S. military for temporarily housing military personnel, equipment, and supplies. Ideally, such shelters should be designed for storage in a compact configuration that can be easily transported to a new destination for assembly. The assembly and disassembly process should be relatively quick and easy and require few hand tools.

In many instances, it is desirable for the assembled shelter to be used to house personnel or medium-sized equipment. In order to do so, the shelter must include both personnel and motor vehicle doors.

For military use, such shelters must be designed for use in both hot and cold external environments and hurricane wind conditions. Optionally, the shelter should maintain an inside temperature of 80 degrees F. to 55 degrees F. when the outside ambient temperature is 125 degrees F. to −25 degrees F., respectively. In order to meet these parameters, adequate insulation and compact and efficient heating and cabling systems must be used.

SUMMARY OF THE INVENTION

It is an object of the present invention to provide a compact, all-weather, temporary shelter designed for both personnel and equipment.

It is an object of the present invention to provide such a shelter that is designed for relatively quick and easy erection and teardown using common hand tools.

It is another object of the present invention to provide such a shelter that includes insulation means so that it may be used in hot and cold environments and hurricane wind conditions.

It is a further object of the present invention to provide such a shelter that can be stored in a compact configuration for transport in an aircraft.

These and other objects of the invention which will become apparent are met by a compact, all-weather, temporary shelter comprising a lightweight, easy-to-assemble frame covered with a durable, main outer cover. The frame includes a plurality of lightweight, arched frame supports interconnected by purlins. The arched frame supports are made of curved components that are longitudinally aligned and snap-fit together for easy assembly and disassembly. After assembly, the arched frame supports are transversely aligned, spaced apart, and connected at their opposite ends to the opposite sides of a square or rectangular base. The base is made of a plurality of side members temporarily connected together in an end-to-end manner and attached to the ground with spikes. The outer cover extends over the outer surfaces of the arched frame supports and is held in place at its edges with cables and quick-release connectors. The opposite ends of the shelter include vertical end walls also made of lightweight support members which are covered with durable end outer covers made of similar material used for the main outer cover. The lateral edges of the main outer cover overlap the upper edges of the end outer covers, thereby creating a wind-tight enclosure.

The shelter also includes a lightweight inner liner disposed over the entire length and width of the frame. In the preferred embodiment, the inner liner is made of a plurality of panels attached to the inside surfaces of the arched frame supports. The outer cover and inner liner are spaced apart on opposite sides of the arched frame supports, thereby creating a plurality of transversely aligned duct spaces between the arched frame supports. After assembly, the heat and air conditioning units transmit heated or cool air into the shelter via the duct spaces. Over the central, longitudinal axis of the shelter, the inner liner extends horizontally across the shelter thereby creating a central, large air space between the main outer cover and the inner lining which acts as an insulation layer to minimize heat exchange.

Assembled on at least one end wall is a large, lightweight vehicle door. In the preferred embodiment, the vehicle door is made of two vehicle door components connected via a hinge means to a surrounding vehicle door frame constructed in the end wall. Each vehicle door component is made of two lightweight smaller panels longitudinally aligned and connected together during assembly. In the preferred embodiment, each panel includes an outer rigid frame covered with a durable fabric cover. The same end wall or the opposite end wall may also include a personnel door.

The entire shelter when disassembled is designed to be stored in a rectangular-shaped container designed to fit into the fuselage of a military aircraft. The shelter also includes electrical panels and outlets to be connected to a standard or military, portable electrical power generator.

DESCRIPTION OF THE PREFERRED EMBODIMENT(S)

Figure 2:
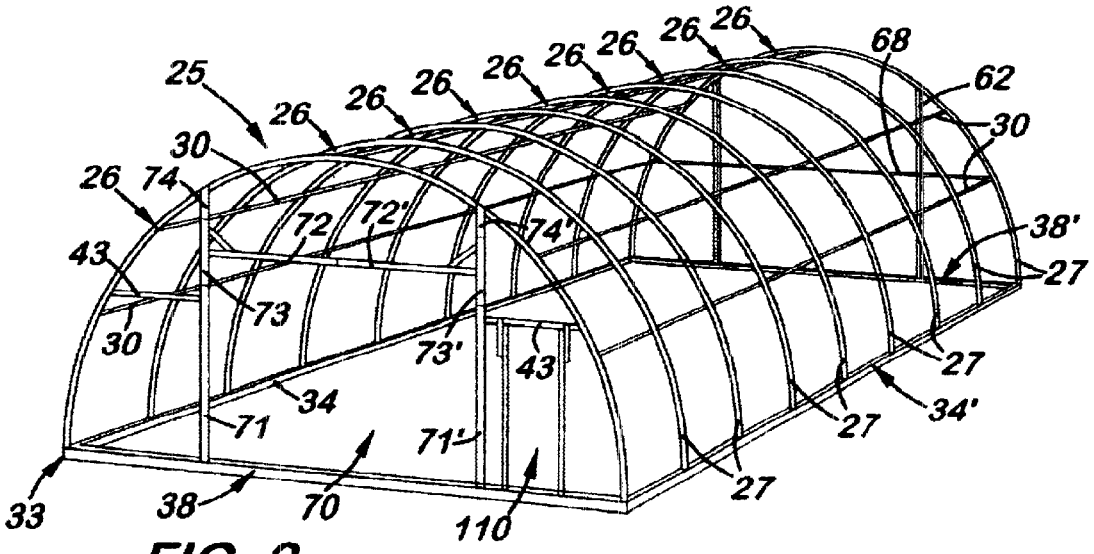
FIG. 2 is a perspective view of the structural frame used in the shelter.
Figure 3:
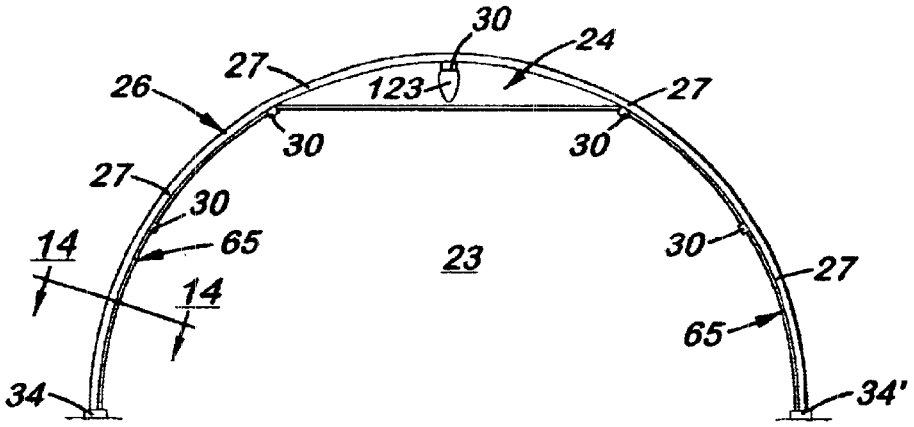
FIG. 3 is a side elevational view of an arched frame support showing the installation of an inner liner on the inside surface of an arched frame support.
Figure 5:
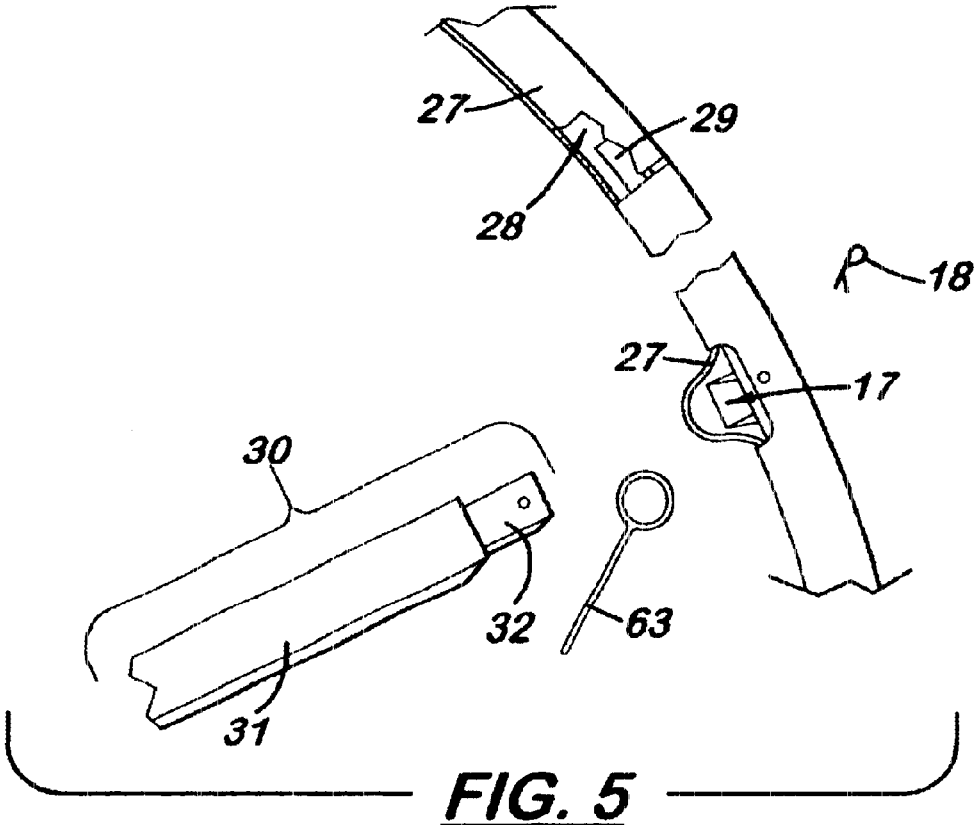
FIG. 5 is a perspective view showing two curved components being longitudinally aligned and connected together, a transversely aligned purlin being attached to a bracket attached to an arched frame support, and a cable located on the edge of the main outer cover extended around the bracket.

Referring to the accompanying Figs., there is shown and described a compact, all-weather temporary shelter 20 comprising a lightweight, easy-to-assemble 180° arched frame 25 covered with a durable outer cover 50 and two opposite end walls 14, 15 covered with end wall covers 150. As shown in FIGS. 2 and 3, the arched frame 25 includes a plurality of lightweight arched frame supports 26 attached at their opposite ends to a square or rectangular-shaped base 33. The arched frame supports 26 extend transversely over the base 33 and are made of a plurality of curved components 27 connected end-to-end. The arched frame supports 26 are vertically aligned and equally spaced apart over the base 33 and interconnected with adjacent arched frame supports 26 by horizontally aligned purlins 30. In the preferred embodiment, each curved component 27 has an insert member 29 formed on one end and a hollow opening 28 at the opposite end designed to receive the insert member 29 on an adjoining curved component 27, as shown in FIG. 5. During assembly, the curved components 27 are longitudinally aligned and slip-fit together. When the entire arched frame support 26 is lifted and the outer two curved components 27 are forced inward, the remaining curved components 27 are locked together so that the outer two curved components 27 may be attached to the base 33. Each curved component 27 is made of aluminum rectangular tubing measuring approximately 91⅜ inches in length and 2×4 inches (width×length) in cross section. Four curved components 27 are used to make each arched frame support 26.

The purlins 30 are designed to slip fit into brackets 17 attached to the sides of the curved components 27. Each purlin 30 comprises a short, straight section 31 with a narrow insert member 32 attached or formed at each opposite end. During assembly, the purlins 30 are perpendicularly aligned between two arched frame supports 26 so that the insert members 32 are inserted into brackets 17 attached to adjacent arched frame supports 26. Optional hitch pins 18 are then used to hold each insert member 32 in the bracket 17. In the preferred embodiment, there are five (5) longitudinally aligned rows of purlins 30.

Figure 7:
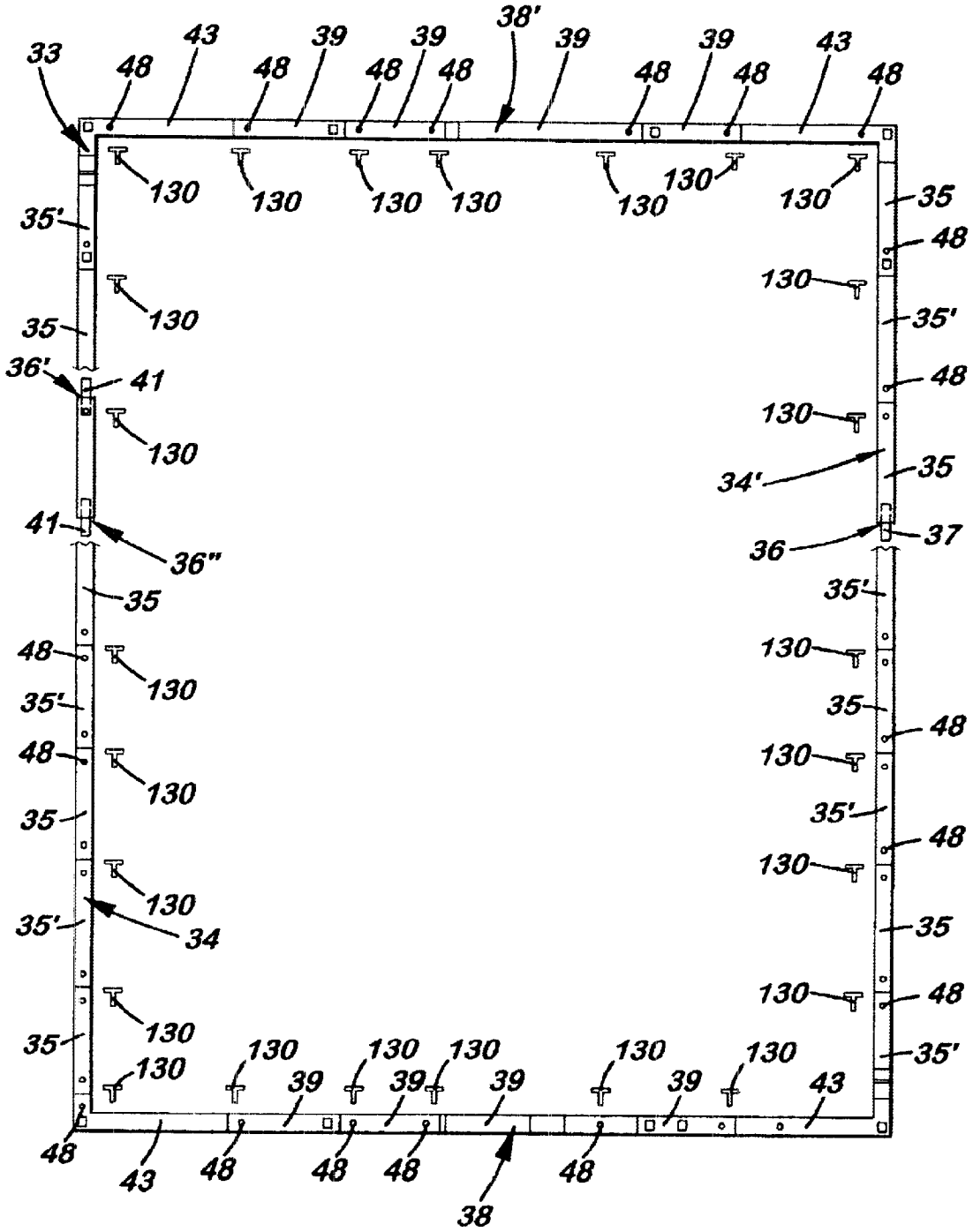
FIG. 7 is a top plan view of the base used in the frame.
Figure 8:
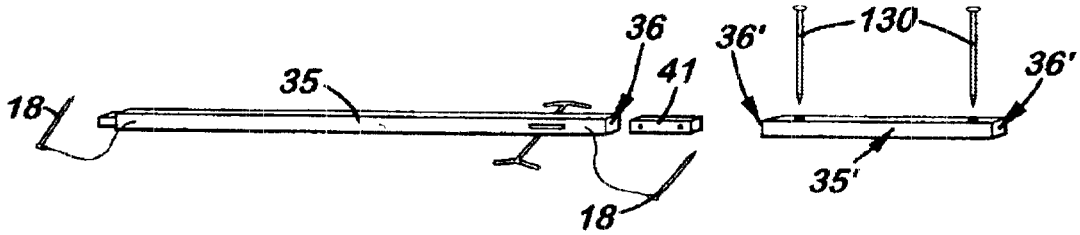
FIG. 8 is a perspective view of two straight members used in the base with insert members used to connect them together and stakes used to attach them to the soil.

As shown more clearly in FIGS. 2 and 7 the overall shape of the base 33 is rectangular and comprises two side base members 34, 34' and two end base members 38, 38'. In the preferred embodiment, the two side base members 34, 34' are made of two alternating straight members 35, 35'. The first straight member 35 has one hollow open end 36 and one fixed insert member 37 formed or attached to the opposite end. The second straight member 35' has two opposite open ends 36', 36" with two adjustable insert members 41 attached to its opposite ends. Both the fixed insert members 37 and the adjustable insert member 41 are used to attach the first and second straight members 35, 35' together.

Figure 9:
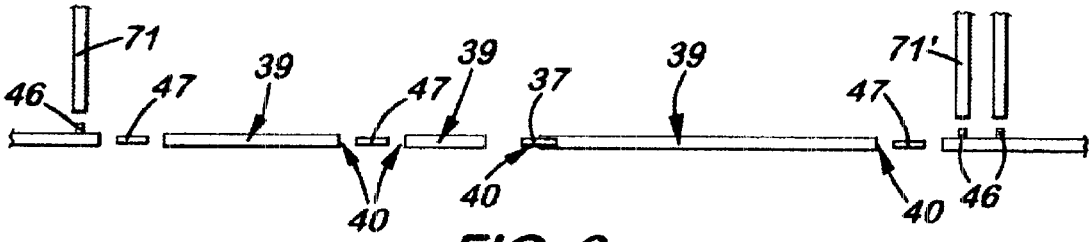
FIG. 9 is a side elevational view similar to the view shown in FIG. 8 that now shows the straight member used on the end base members

Each end base member 38, 38' is made of a plurality of longitudinally aligned straight members 39. As shown in FIG. 9, each straight member 39 has an open end 40 with either a fixed or adjustable insert member 37 or 41 formed on or attached to the opposite end. During assembly, the insert member 41 on one straight member 39 is inserted into the open end 40 of an adjacent straight member 39 to attach them together. On the end wall 14 with a vehicle door opening 70 and personnel door opening 110, discussed further below, the end base member 38 includes modified threshold members 111. During assembly, the location of the adjustable insert member 41 is adjusted on the ends of the adjoining straight members 35, 35', and 39 to accommodate uneven ground and small twists in the base 33.

Figure 6:
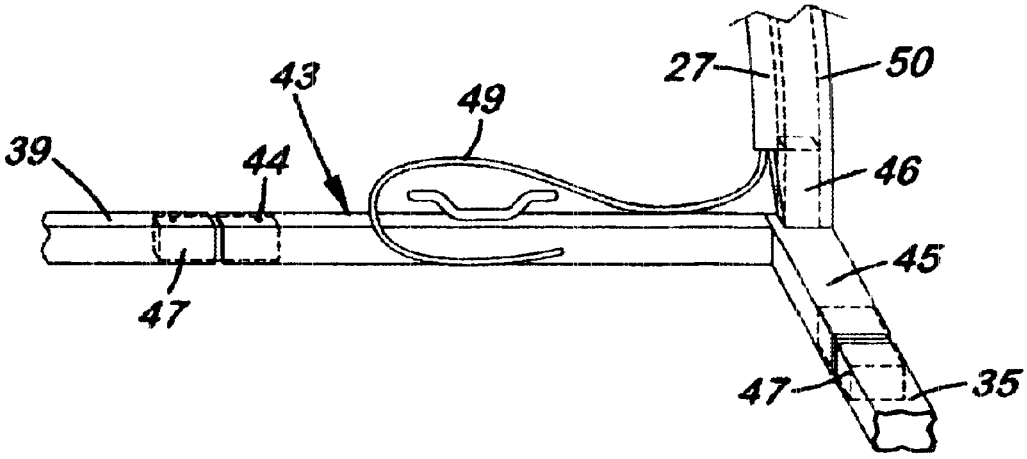
FIG. 6 is a perspective view showing a corner member being attached to a straight member and an end arched frame support.
Figure 10:
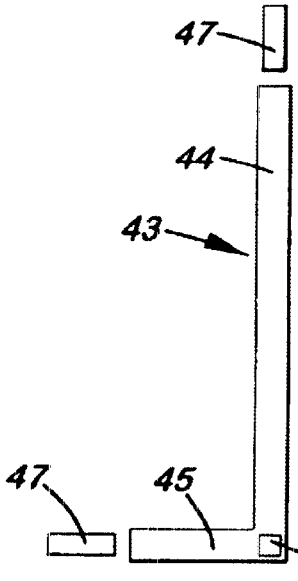
FIG. 10 is a top plan view of a L-shaped corner member showing the insert members being inserted into its opposite ends.

As shown in FIGS. 6, 9, and 10, L-shaped corner members 43 located at the corners of the base 33 are used to connect the ends of the adjoining straight sections 35, 35', and 39 used in the side base members 34 and end base member 38, respectively. The corner members 43 comprise a long leg 44 and a perpendicularly aligned short leg 45. Attached to the corner of each corner member 43 is an upward extending stub 46 which attaches to the end of the curved component 27 used on the end arched frame support 26. Formed on the opposite ends of the corner member 43 is a fixed insert member 47 that fits into the open ends of straight members 35, 35', 39, respectively. The members 35, 35', 39, and 43 are made of aluminum rectangular-shaped tubing measuring approximately 2×4 inches (width×length) in cross section.

Once the base 33 has been assembled, stakes 130 are extended through bores 48 formed on the straight members 35, 35', and 39 and corner members 43 to connect the base 33 to the ground.

Figure 13:
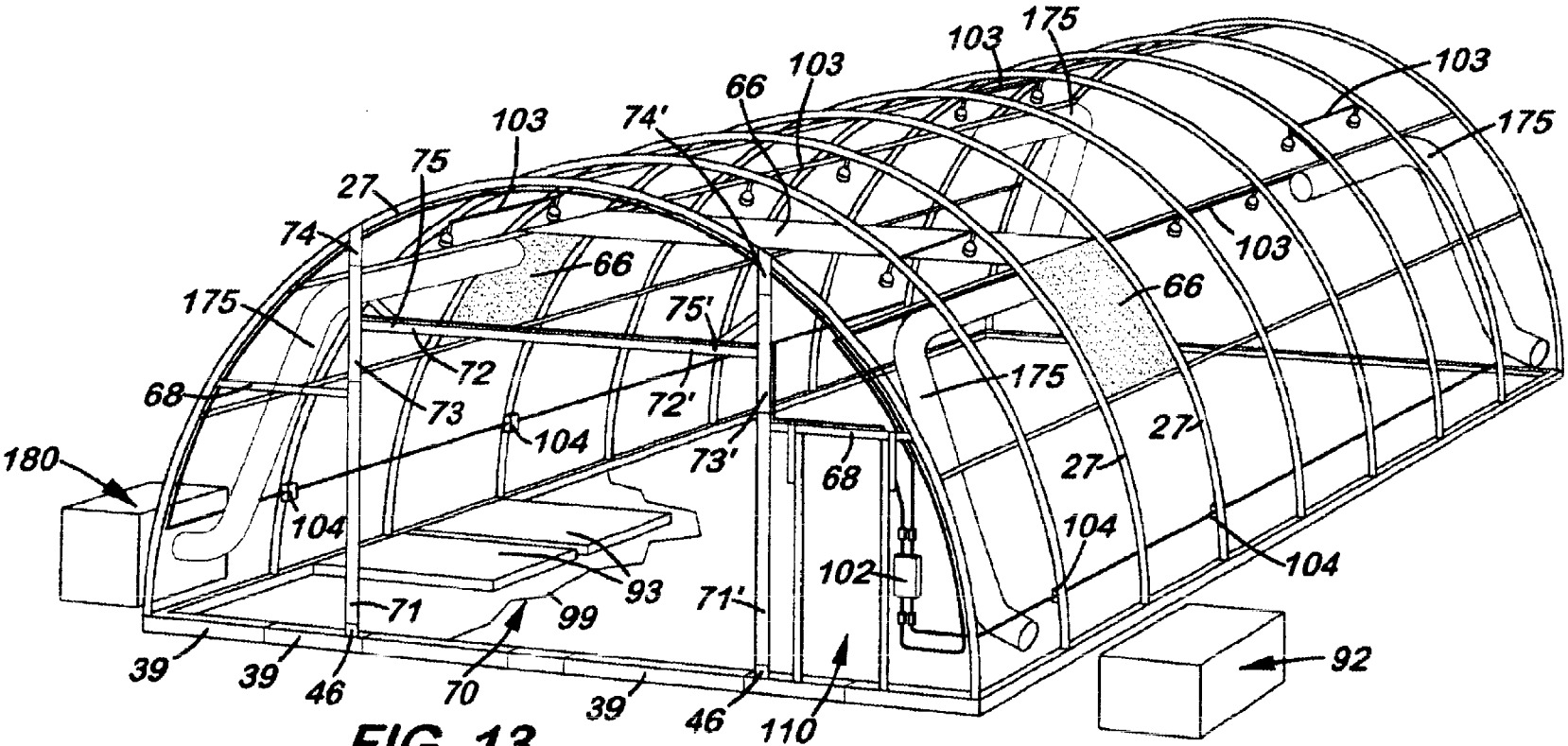
FIG. 13 is a perspective view of a partially assembled shelter showing the relative positions of the inner liner, the air conduits, the ventilation unit, the electrical fuse panel, lighting fixtures, and electrical plug-ins.

As shown in FIG. 13, formed on the end wall 14 is one motor vehicle door opening 70 and one personnel door opening 110. The motor vehicle door opening 70 is formed between two lower vertical members 71, 71' and two T-shaped members 72, 72'. The upper ends of a vertical member 71, 71' are attached to the vertical leg members 73, 73' on one T-shaped member 72, 72'. The opposite vertical legs 74, 74' on the T-shaped members 72, 72' are attached to the inside surfaces of the end curved component 27. The two center legs 75, 75' of the T-shaped members 72, 72' are longitudinally aligned and connected together at their opposite ends to form a header over the motor vehicle door opening 70.

Figure 1:
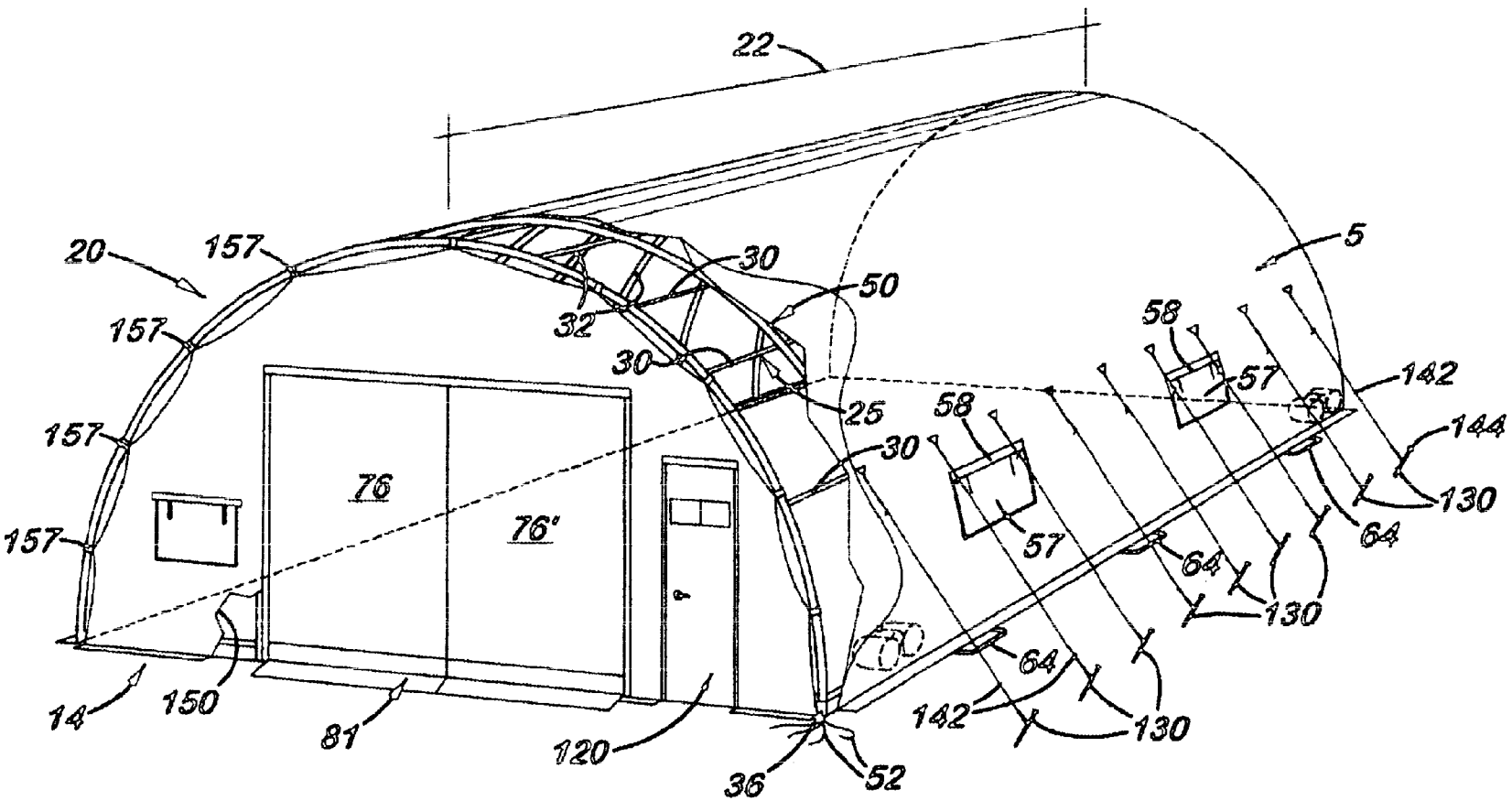
FIG. 1 is a perspective view of an assembled compact, all-weather temporary shelter disclosed herein.

The lower ends of the vertical members 71, 71' are connected to the upward extending stubs 46 formed on the straight members 39 located below the motor vehicle opening 70. The upper ends of the vertical legs 74 are directly attached to the curved components 27 using suitable connectors (not shown). A plurality of horizontally aligned cross members 68 are used to connect the vertical members 71, 71' to the inside surfaces of the adjacent end curved components 27. The motor vehicle door opening 70 is sufficient to allow a motor vehicle or other similar-size object to be stored inside the shelter 20. Assembled inside the motor vehicle door opening 70 is a large vehicle door 81 made of two swinging vehicle door components 76, 76', shown in FIG. 1.

Figure 11:
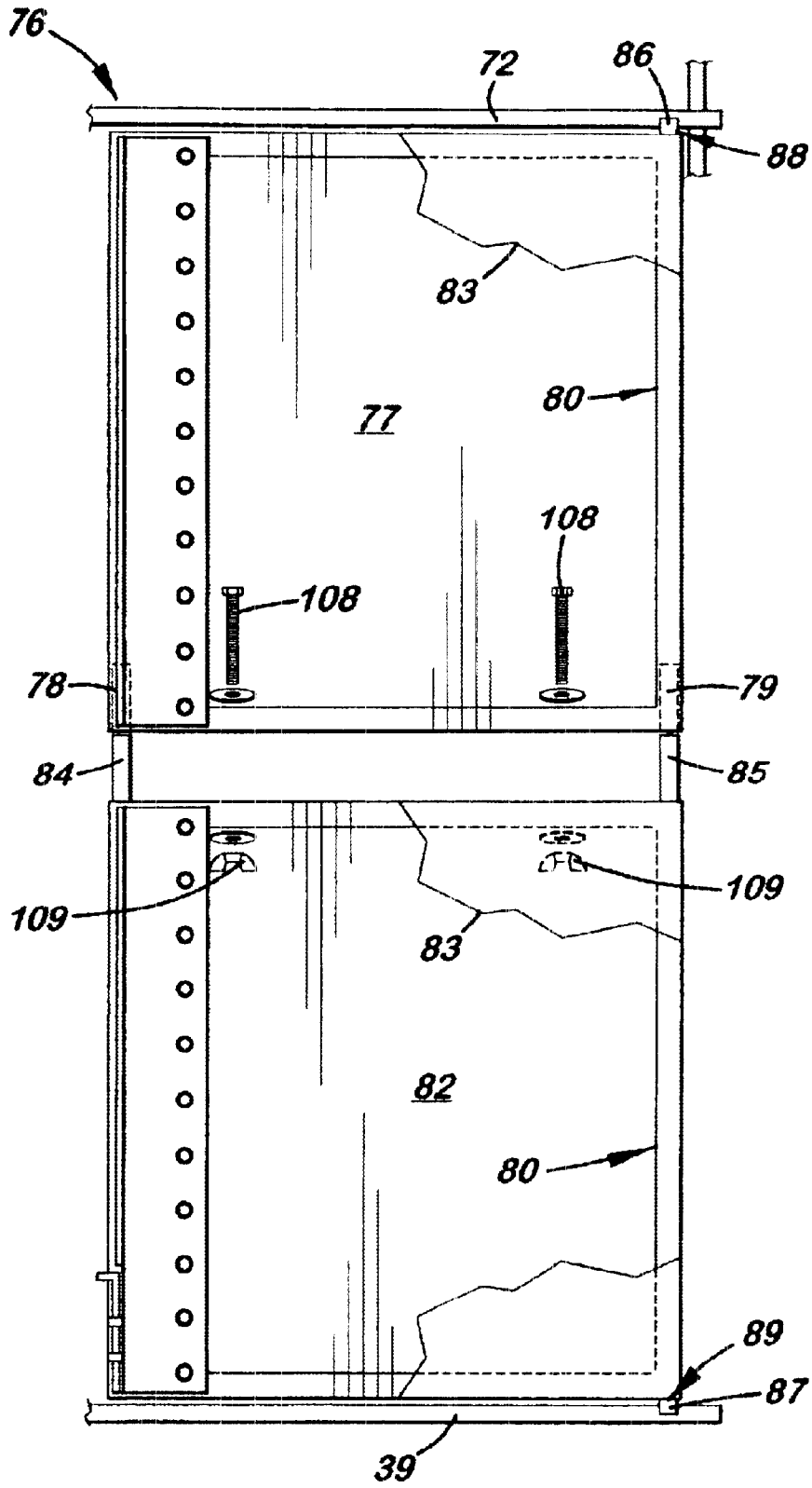
FIG. 11 is a front elevational view of an upper and lower panel being joined together to form a vehicle door component.

As shown in FIG. 11, each vehicle door component 76 is made of an upper and lower panel 77, 82, respectively, longitudinally aligned and selectively connected together. Each panel 77, 82 includes a square outer frame 80 covered with a lightweight cover 83 made of durable rigid material, such as aluminum and/or fabric. Extending upward from the corners of the lower panel 82 are two pins 84, 85 that are inserted into two bores 78, 79 formed on the lower surface of the upper panel 77 and frame 80. During assembly, the edges of the panels 77, 82 are aligned and the pins 84, 85 are inserted into the bores 78, 79. Bolts 108 and wing nuts 109 are then used to securely connect the panels 77, 82 together. Formed on the upper inside corner of the upper panel 77 and the inside corner of the lower panel 82 are pegs 86, 87, respectively, that are inserted into bores 88, 89, formed on the center leg 75 of the T-shaped member 72 and the end base member 38, respectively.

Figure 12:
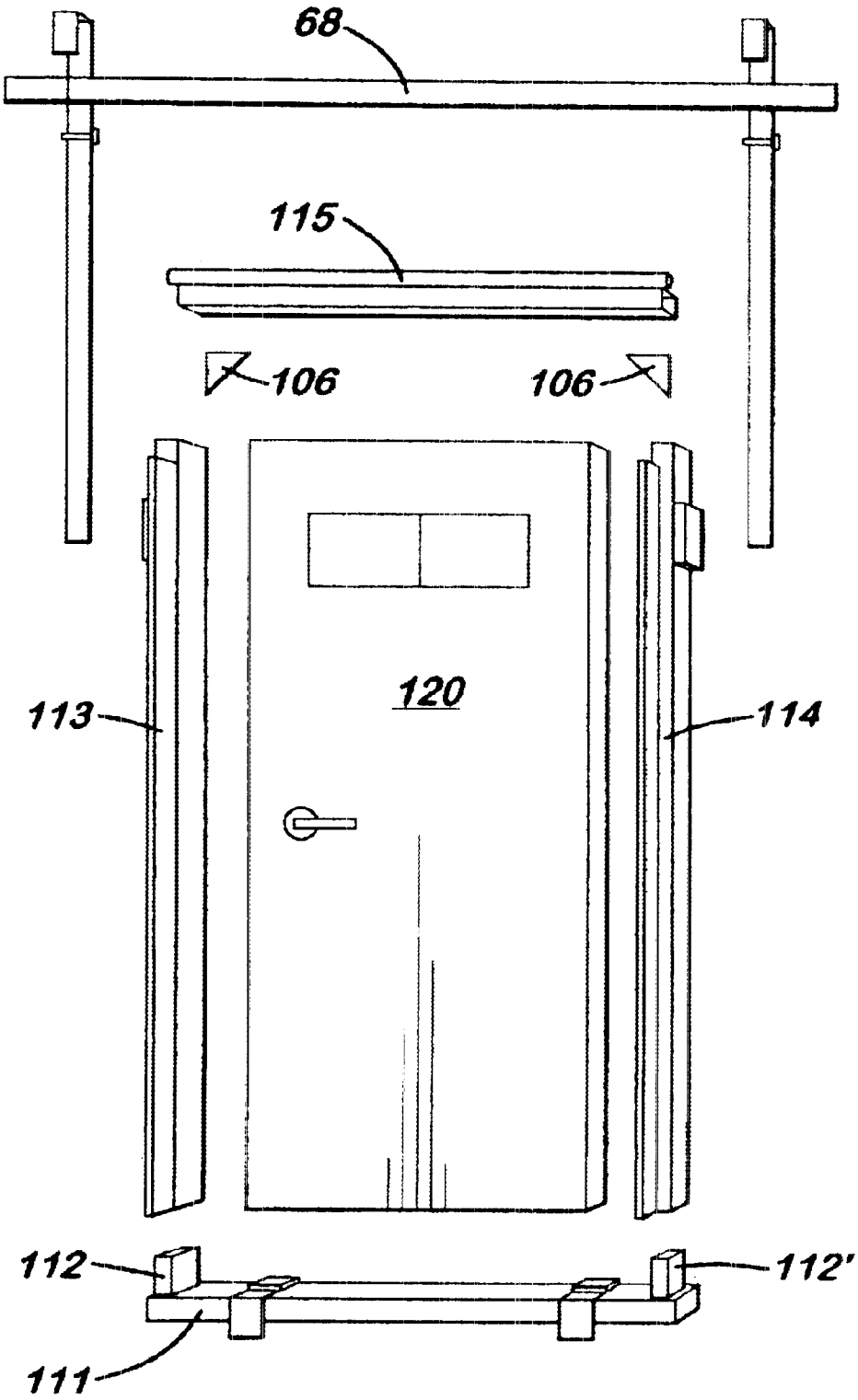
FIG. 12 is an exploded, front elevational view of a personnel door and its surrounding frame members.

The same end wall 14 or the opposite end wall 15 may include a personnel door opening 110 designed to receive a personnel door 120, shown in FIG. 12. The personnel door opening 110 is created between a threshold member 111, two vertical jam members 113, 114 and a lower header 115. The lower header 115 is located under cross member 68. The threshold member 111 includes two upward extending stubs 112, 112' that connect to the lower ends of the vertical jam members 113, 114, respectively. The upper ends of the vertical jam members 113, 114 are attached to angled corner members 106 that engage the ends of the lower header 115. In the preferred embodiment, the personnel door 120 is a standard 80×32 inches and made of lightweight material.

The end wall 15 is made by a plurality of vertical members 62 evenly spaced apart. Optional cross members 68 may be used between vertical members 62 to provide stability.

Once the base 33, frame 25, and end walls 14, 15 are assembled, the outer cover 50 is then disposed over the arched frame supports 26 and extends longitudinally and transversely over the arched frame 25. The opposite longitudinally aligned edges of the outer cover 50 connect to the side base members 34, 34' on the base 33 by hold down cables 52 that extend longitudinally along the side base members 34, 34'. The ends of the hold down cables 52 are attached to hooks 53 located on the outer surface of the side base members 34, 34'. Attached to the transverse edges of the outer cover 50 are contour cables 49. Also attached to the outer surface of the outer cover 50 is a plurality of O-rings 56. In the preferred embodiment, a plurality of window openings 57 are also formed in the outer cover 50. Attached to the outside surface of the outer cover 50 above each window opening 57 is an optional roll-up flap 58. Optional tie down cables 142 that attach to the O-rings 56 are used to keep the outer cover 50 tight. Also, optional guy lines 63 located between the purlins 30 keep the arched frame supports 26 vertically aligned.

The outer cover 50 is made of polyester reinforced vinyl fabric and is sufficient in width and length to completely extend longitudinally and transversely over the erected arched frame supports 26. Attached to the longitudinal edges of the outer cover 50 are pull loops 64 used to pull and hold the longitudinal edges over the assembled frame 25. In the preferred embodiment, the outer cover 50 is approximately 14 ounces per square yard and measures approximately 48 feet by 53 feet (width×length). The outer cover 50 may have a camouflaged exterior color that matches the environment. The outer cover 50 may also include a blackout element (not shown) to prevent emission of light to the outside.

Figure 17:
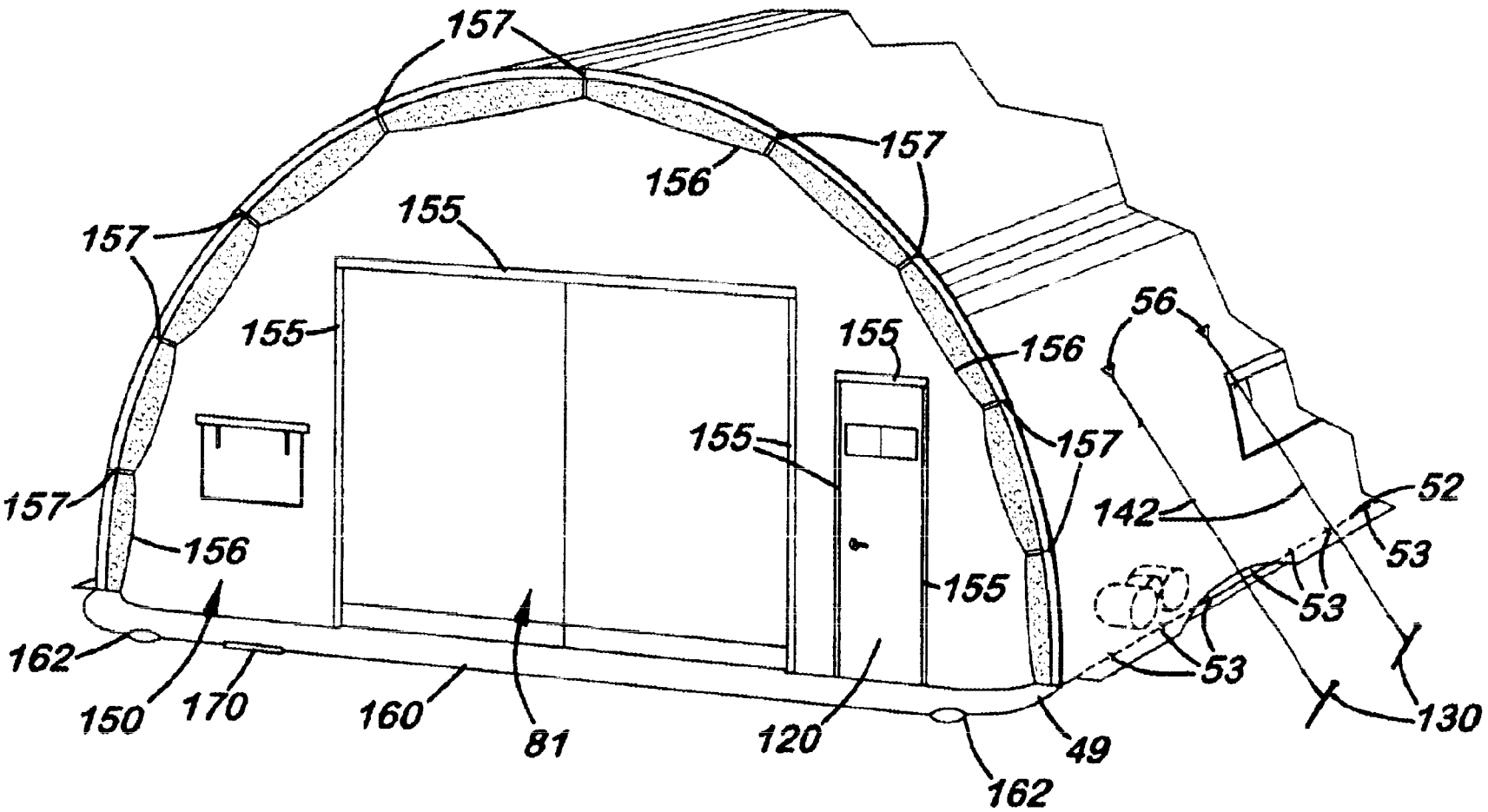
FIG. 17 is a partial perspective view of an end wall of the shelter showing the use of a cable used to pull and attach the main outer panel over the frame.

The end walls 14, 15 are covered by semi-circular shaped end wall covers 150 made of the same material used to make the outer cover 50. Formed around the edges of the end wall covers 150, aligned and registered adjacent to the motor vehicle door and personnel door openings 70, 110 are ketters 155 designed to receive the adjacent vertical members 71, 71', 73, 73'. Attached to the upper arched edge of the end wall cover 150 is a contour cable 156. Evenly spaced apart and attached to the lower surface of the end curved component 27 is a short cable 157 that holds the contour cable 156 adjacent to the inside surface of the end arched frame support 27, as shown in FIG. 17.

Figure 4:
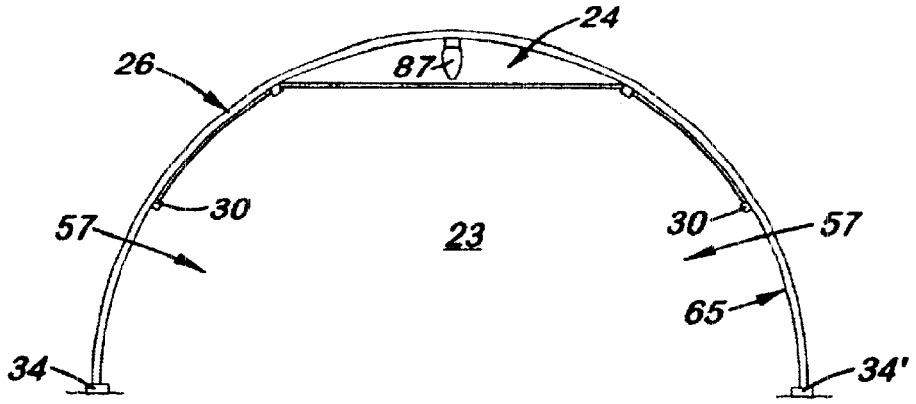
FIG. 4 is a side elevational view of an arched frame support showing the placement of the inner liner on the inside surface of an arched member with windows formed on opposite sides of the arched frame support.
Figure 14:
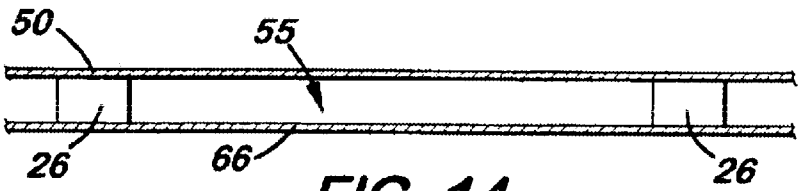
FIG. 14 is a sectional view taken along line 14, 14' in FIG. 3 showing the creation of air duct space between the main outer panel and inner lining on adjacent arched frame supports.

As shown in FIG. 3, the shelter 20 also includes a lightweight inner liner 65 to provide insulation barrier inside the shelter 20. As shown in FIG. 14, the inner liner 65 comprises a plurality of narrow liner panels 66 that span transversely inside the bay between two adjacent arched frame supports 26. In one embodiment, the liner panels 66 are sufficient in length to extend from one side base member 34 of the base 33 to the opposite side base member 34', as shown in FIG. 3, in another embodiment, the liner panels 66 are shorter and attached to purlins 30 located above the window opening 57 on one side of the shelter 20 to a purlin 30 located above the window opening 57 located on the opposite side of the shelter 20, as shown in FIG. 4. In both embodiments, the perimeter edges of the liner panels 66 are attached to the lower surface of the arched frame supports 26 and to the base 33 or purlin 30 via snaps or hook and loop connectors (not shown).

Because the inner panels 66 are spaced apart from the outer cover 50, narrow duct spaces 55 are thereby created between adjacent arched frame supports 26, as shown in FIG. 14. As shown in FIGS. 3 and 4, near the center axis 22 of the shelter 20, the liner panels 66 extend horizontally across the shelter 20 and between the purlins 30 located on opposite sides of the shelter center axis 22, thereby creating a large, attic-like space 24 above the center living space 23 of the shelter 20. A strap 123 attached to the center purlin 30 is used to hold the center of the liner panel 66 upward. The large, attic-like space 24 and small duct spaces 55 are in communication and thereby provide a circulating layer of air for insulation.

The liner panels 66 are made of aluminized polyethylene and are sufficient in length and width to extend between the arched frame supports 26 and across the shelter 20. In the preferred embodiments, the liner panels 66 are six millimeters thick and measure approximately 6 feet 6 inches×48 feet (width×length).

The shelter 20 may also include a ground cover 99 and a plurality of square floor panels placed over the ground cover.

The shelter 20 includes a wiring harness (not shown), an electrical fuse panel 102, and lighting and electrical outlets 103, 104. The electrical fuse panel 102 is designed to connect to a standard, military-issued electrical power generator 92 by use of a military/commercial plug adapter. Ventilation tube ducts 175 connect to the environmental control unit 180 to more evenly distribute the air throughout the shelter 20. In the preferred embodiment, there are four tube ducts 175 that deliver air from the inlet port of the environmental control unit 180 to the four corners of the shelter 20. The ends of the tube ducts 175 terminate inside the narrow duct space 55 located just above the second purlin 30.

Figure 15:
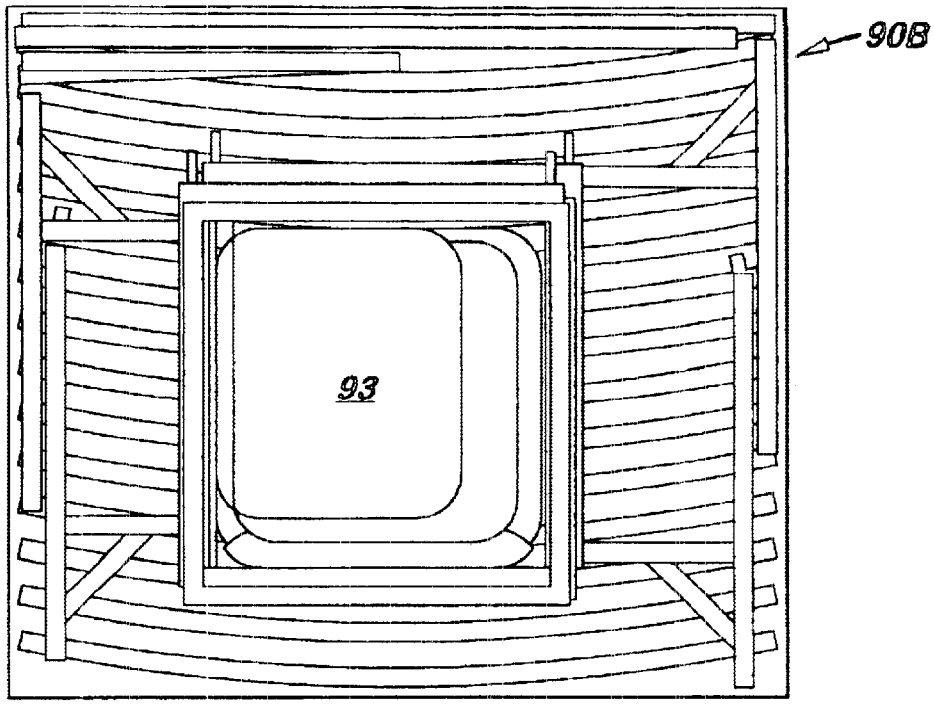
FIG. 15 is a top plan view of the container lower body shown packed with the components used to construct the shelter.
Figure 16:
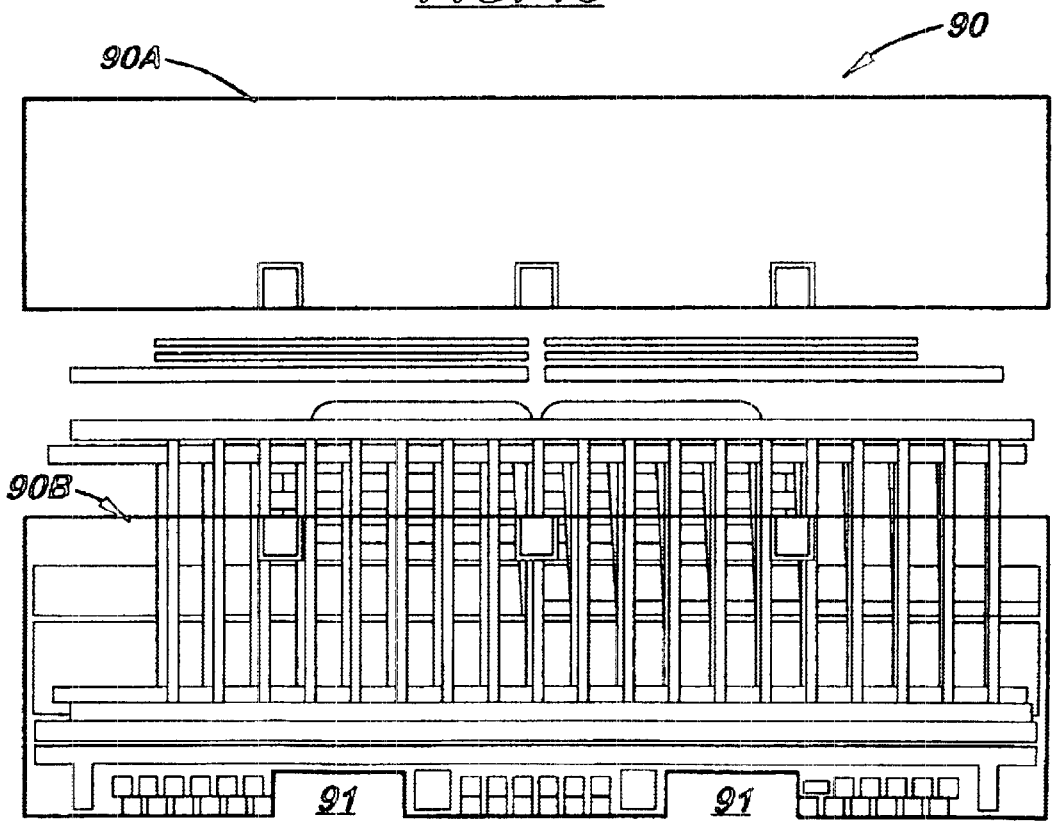
FIG. 16 is an exploded side elevational view of the container showing the relative positions of the components stored therein.

As mentioned above, the shelter 20 is designed to fold into a rectangular-shaped container 90, shown in FIGS. 15, 16, which comprises an upper lid 90A and a lower body 90B. The upper lid 90A and lower body 90B have outer shapes so that they fit into the fuselage of a large, military-style transport aircraft. In the preferred embodiment, the volume of the container 90 is approximately 220 cubic feet and measures approximately 84 inches in width, 96 inches in length, and 48 inches in height. When packed with all of the components used to assemble the shelter 20, the container 90 weighs approximately 3,940 lbs. Using a container 90 with these dimensions and weight, six containers 90 may be placed into a C-125 aircraft. Forklift cutouts 91 are formed on the bottom of the container 90 so that a forklift may securely lift the container 90.

The shelter 20 may be assembled in four hours with six individuals using an end wrench, an extension cable, a power pull, a cover carry panel, a string line, a sledgehammer, a 100-foot tape measure, a four-foot stepladder, an extension stepladder, a drive rod, a screwdriver, and a 53-foot pullover rope. A spike driver socket and spike driver shaft are provided to interface with a jackhammer if available.

In the preferred embodiment, the shelter 20 measures 29.5 feet in width, 52 feet in length, and 15 feet in height.

Each vehicle door component 76, 76' measures approximately 11 feet in width and 10½ feet in height. In the preferred embodiment, the two panels 77, 82 that make up each door component 76, 76' have an aluminum outer frame 80 covered by a fabric cover 83. The two panels 77, 82 are connected together via bolts 108 and wing nuts 109 (not shown). The personnel door 120 is one structure, made of aluminum, and measures approximately 26 inches in width and 80 inches in height.

Assembly

During assembly, a forklift is used to deliver the container 90 to the flat assembly site, which should measure approximately 35 feet by 60 feet. The components of the shelter 20 are then manually removed from the container 90. The components may be color-coded for easy assembly.

The side, end, and L-shaped corner members 34, 38, 43, respectively, are selected and used to assemble the base 33. The members 34, 38, 43 are then attached to the ground using eighteen-inch, double-headed stakes 130 through pre-drilled anchor holes formed in the side and straight members 35, 39. Hitch pins 18 may be used to interconnect the members 34, 38, 43. Optional ground cover 99 and/or insulated floor pads 93 may be used in the shelter 20.

Next, the curved components 27 used to construct the arched frame supports 26 are selected and assembled. The ends of the two curved components 27 are forced inward and then connected to the base 33. The purlins 30 are then connected between adjacent arched frame supports 26.

As mentioned above, the vertical members 62 and cross members 68 are installed on the end wall 15 not having a vehicle door opening 70 or personnel door opening 110. On the end wall 14 with a motor vehicle door opening 70, the vertical members 71, 71' and the T-shaped members 72, 72' are first assembled. The door components 76, 76' are then attached inside the motor vehicle opening 70.

After the arched frame supports 26 are assembled and attached to the base 33 and the purlins 30 are attached, the end walls 14, 15 are then constructed. The end walls 14, 15 are fully constructed on the ground and then lifted into position over the ends of the frame 25. After the end walls 14, 15 are constructed and lifted into position, the vehicle door 81 and personnel door 120 are then assembled and attached to the end wall 14.

To construct the end walls 14, 15, the vertical and cross members 71, 75, 68 are first selected. The vertical and cross members 62, 68, respectively, are first then inserted into the appropriate ketter 155 formed on the end wall cover 150. The ends of the vertical and cross members 62, 68 are then connected together as described above. The vertical and cross members 62, 68 and end wall cover 150 are then lifted into position so that the end wall contour cable 156 is located adjacent to the end arched frame support 26.

Next, the outer cover 50 is longitudinally aligned along one side of the shelter 20 and pulled transversely over the arched frame supports 26 so that the outside (tan) side of the outer cover 50 is exposed to the outside environment and the inside (green) side is on the inside environment of the shelter 20. During erection, pullover ropes (not shown) are attached to the pullover loops 162 located along the longitudinal edge of the outer cover 50. To pull the outer cover 50 over the arched frame supports 26, six persons pull in unison on the pullover ropes. To reduce the friction between the inner liner 65 and the outer cover 50, one person should flap the outer cover 50 up and down on the opposite side of the shelter 20 from the opposite person pulling. The outer cover 50 is then up and over the shelter 20. Working at one end of the shelter 20, the outer cover 50 hold down cables 52 are then inserted through the slits located in the end outer cover ground flap (not shown). The ground flap is then raised so that both ends of the outer cover 50 hold down cable 52 may be fastened to a cleat (not shown) attached to the respective end base member 38. The opposite longitudinal edge of the outer cover 50 is then secured to the opposite end wall 14, 15 in the same manner. The symmetry of the outer cover 50 over the shelter 20 is then checked.

A power pull 170 and extension cable 160 are then used to tension the end of the outer cover 50 hold down cable 52 until the outer cover 50 is drawn tight over the arched frame supports 26. One end of the extension cable 160 is then tied to a cleat (not shown) attached to the base 33. The opposite end of the extension cable 160 along the side of the shelter 20 is then pulled and secured to a cleat (not shown) located on the opposite side of the base 33.

The electrical distribution fuse panel 102, lighting and electrical outlets 103, 104 are then assembled in the shelter 20.

The liner panels 66 are unfolded and selected. The two short liner panels 66 are installed in bays with window openings 57 and the four long liner panels 66 are disposed over bays without window openings 57. Once selected, the liner panels 66 are then attached between the arched frame supports 26. Duct spaces 55 are then formed between the arched frame supports 26. The ventilation tube ducts 175 are then selected and extended from the environmental control unit 180 to the four corners of the shelter 20. An electric environmental control unit 180 (only one shown) is then connected to each ventilation tube duct 175, and to the electrical distribution fuse panel 102. The electrical power generator 92 is then connected to the fuse panel 102.

In compliance with the statute, the invention described herein has been described in language more or less specific as to structural features. It should be understood, however, that the invention is not limited to the specific features shown, since the means and construction shown, comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A compact, all-weather temporary shelter, comprising:

a. an arched frame made of a plurality of spaced-apart, arched frame supports connected at their opposite ends to a base frame, each said arched frame support being held in a parallel, vertical alignment extending between opposite sides of said base frame;

b. two opposite, vertically aligned end walls;

c. at least one set of adjacent vehicle doors pivotally connected to at least one said end wall, each said vehicle door being made of at least two smaller panels selectively connected together;

d. at least one personnel door pivotally connected to at least one said end wall;

e. an outer cover disposed over and connected to said arched frame supports;

f. an end wall cover disposed over each said end wall;

g. an inner lining attached to the inside surface of said arched frame supports, said lining being spaced apart from said outer cover, thereby creating transversely aligned air ducts between each said arched frame support; and, h. an air exchange means connected to said air ducts to provide heated or cooled air to said shelter.

2. The temporary shelter, as recited in claim 1, wherein said arched frame supports comprise a plurality of curved components selectively connected together in an end-to-end manner.

3. The temporary shelter, as recited in claim 2, wherein said curved components are slide fitted together.

4. The temporary shelter, as recited in claim 1, wherein said arched frame supports are interconnected by a plurality of purlins.

5. The temporary shelter, as recited in claim 4, wherein a plurality of said purlins are connected together in an end-to-end manner over the entire length of said shelter.

6. The temporary shelter, as recited in claim 1, further including cables used to connect the ends of said outer cover to said base frame.

7. The temporary shelter, as recited in claim 1, wherein said inner lining is a plurality of separately attached inner panels disposed between adjacent said arched frame supports.

8. The temporary shelter, as recited in claim 1, wherein each said vehicle door is made of at least two panels selectively connected together on their adjoining edges.

9. The temporary shelter, as recited in claim 8, wherein said panels include an outer rigid frame with a fabric panel suspended between said outer rigid frames.

10. The temporary shelter, as recited in claim 1, wherein said inner lining has a central section suspended in horizontal alignment aligned inside said shelter thereby creating a central attic space between said central section and said inner lining.

11. The temporary shelter, as recited in claim 1, further including a compact container capable of storing said frame, said end walls, said vehicle doors, said personnel door, said outer cover, said end wall covers, and said inner lining.

12. The temporary shelter, as recited in claim 11, wherein said compact container is a rectangular-shaped container measuring 84 inches in width, 96 inches in length, and 48 inches in height.

13. The temporary shelter, as recited in claim 1, wherein said outer cover includes at least one window opening.

14. The temporary shelter, as recited in claim 1, wherein said outer cover is made of polyester reinforced vinyl fabric material.

15. The temporary shelter, as recited in claim 1, wherein said inner lining is made of polyethylene.

16. The temporary shelter, as recited in claim 1, further including an air inlet duct to allow air to be delivered inside said shelter.

17. A compact, all-weather temporary shelter, comprising:

a. a frame made of a plurality of spaced-apart, transversely aligned arched frame supports and a plurality of interconnected purlins, said arched frame supports being connected at their opposite ends to a four-sided base frame securely attached to the ground;

b. two opposite end walls;

c. at least one set of adjacent vehicle doors pivotally connected to at least one said end wall, each said vehicle door being made of at least two smaller panels selectively connected together;

d. at least one personnel door pivotally connected to at least one said end wall;

e. an outer cover disposed over said arched frame supports and connected from one side of the base frame to the opposite side of said base frame;

f. a pair of end wall covers placed over said end walls; and, g. an inner lining attached to the inside surface of said arched frame supports thereby creating an air duct between each said arched frame support.

18. The temporary shelter, as recited in claim 17, wherein said arched frame supports comprise a plurality of curved components selectively connected together in an end-to-end manner.

19. The temporary shelter, as recited in claim 18, wherein said inner lining is a plurality of separately attached inner panels disposed between adjacent said arched frame supports.

20. The temporary shelter, as recited in claim 19, wherein said inner lining has a central section suspended in horizontal alignment aligned inside said shelter thereby creating a central attic space between said central section and said outer lining.

* * * * *